United States Patent [19]

Suzuki et al.

[11] Patent Number: 4,617,247

[45] Date of Patent: Oct. 14, 1986

[54] IMPROVED SENSITIZER DYES FOR POLYVINYLCARBAZOLE ELECTROPHOTOGRAPHIC COMPOSITIONS

[75] Inventors: Kiyosuke Suzuki, Saitama; Toshiaki Fukuma, Tokyo; Tatsuru Sato, Chiba, all of Japan

[73] Assignee: Sony Corporation, Tokyo, Japan

[21] Appl. No.: 697,580

[22] PCT Filed: May 21, 1984

[86] PCT No.: PCT/JP84/00256

§ 371 Date: Jan. 10, 1985

§ 102(e) Date: Jan. 10, 1985

[87] PCT Pub. No.: WO84/04825

PCT Pub. Date: Dec. 6, 1984

[30] Foreign Application Priority Data

May 24, 1983 [JP] Japan ..... 58-90963

[51] Int. Cl.[4] ..... G03G 5/06

[52] U.S. Cl. ..... 430/81

[58] Field of Search ..... 430/73, 74, 79, 81, 430/83

[56] References Cited

U.S. PATENT DOCUMENTS

| | | | |
|---|---|---|---|
| 3,619,154 | 7/1968 | Cavagna et al. | 430/93 |
| 3,723,116 | 3/1973 | Kinjo et al. | 430/82 |
| 4,435,492 | 3/1984 | Suzuki et al. | 430/83 |

*Primary Examiner*—John L. Goodrow

*Attorney, Agent, or Firm*—Hill, Van Santen, Steadman & Simpson

[57] ABSTRACT

An improved photosensitive material for electrophotography, said material comprising a mixture of a polyvinylcarbazole or a derivative thereof together with a sensitizing dye consisting of certain alkyl substituted indocyanine derivates, particularly the perchlorates.

16 Claims, 1 Drawing Figure

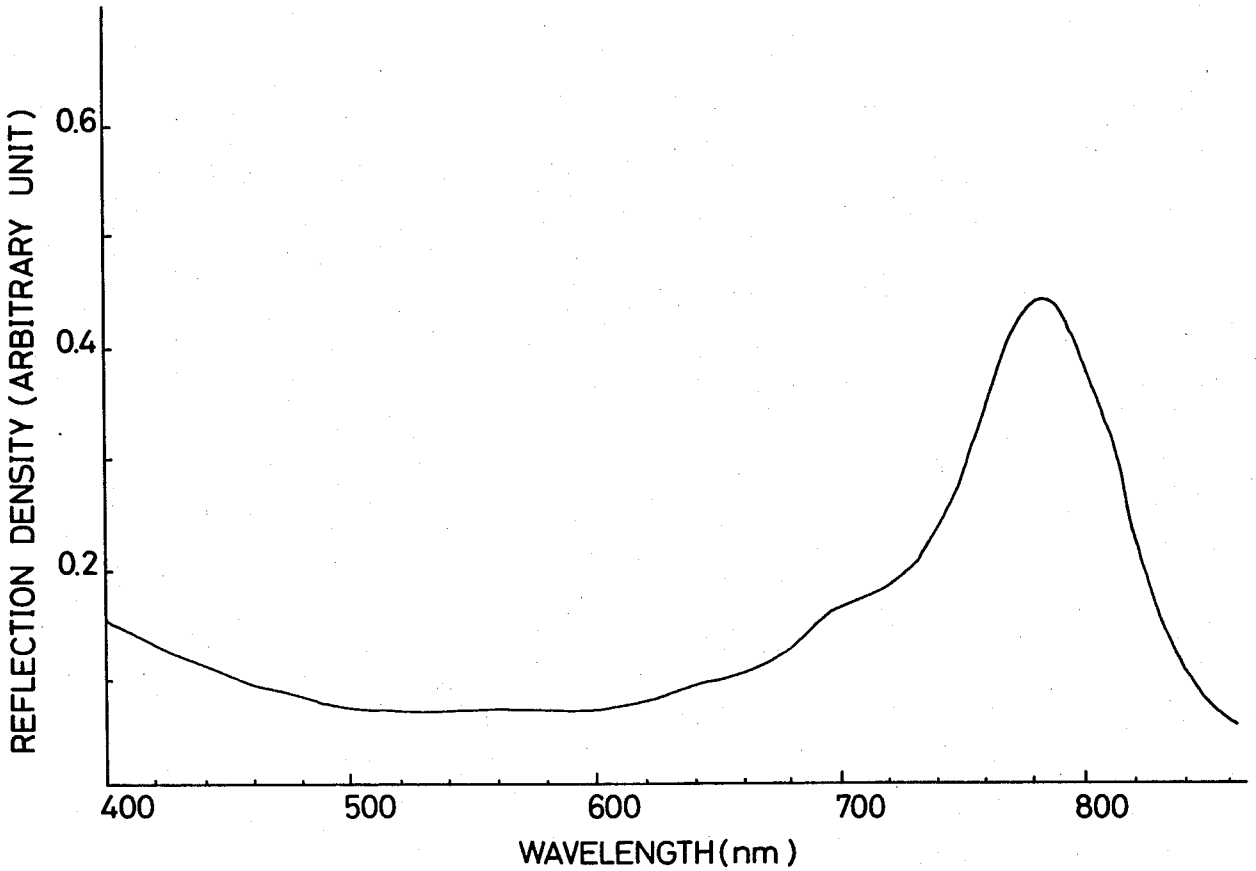
0.6
0.4
0.2
REFLECTION DENSITY (ARBITRARY UNIT)
400
500
600
700
800
WAVELENGTH(nm)

IMPROVED SENSITIZER DYES FOR POLYVINYLCARBAZOLE ELECTROPHOTOGRAPHIC COMPOSITIONS

TECHNICAL FIELD

This invention relates to a photosensitive material for electrophotography, and more particularly to a photosensitive material having high sensitivity for electrophotography, which is capable of constituting a toner-applied surface causing no background coloring. Also, this invention relates to an electrophotographic photosensitive element having a layer of the aforesaid photosensitive material.

BACKGROUND ART

As photosensitive materials for electrophotography, many organic semiconductors have been investigated. In particular, polyvinylcarbazole (PVCz) has been widely used for electrophotographic photosensitive elements for the reasons that PVCz is imparted with a photoconductivity by irradiation of the near ultraviolet light, greatly increases the electric conductivity by exposure to light, easily forms a film, and gives a good surface smoothness in the case of forming a photosensitive layer or film. In such an application, for spectrally sensitizing PVCz to increase its photoconductivity due to the visible light to a practical sensitivity for electrophotography, sensitizing dyes such as triphenylmethane-based dyes, pyrylium-based dyes, cyanine dyes, etc., are added to PVCz.

However, when PVCz having the increased, visible light-induced photoconductivity by a spectral sensitization using conventional sensitizing dyes is used for a photoconductive layer, the following problems may occur.

(1) In the case of a direct type electrophotographic process, since the photoconductive material layer containing the sensitizing dye is colored by the light absorption of the dye to cause background coloring, it is necessary to reduce the amount of the sensitizing dye as low as possible (which causes the reduction of the sensitivity) or to decolor the dye by heat or light after the formation of images (in this case, incomplete decoloring or instabilization to heat or light is liable to occur and hence the restrictions on preserving conditions are increased); and (2) In the case of successive application of yellow, Magenta, cyan and shadow toners onto one photosensitive plate in a color reproducing system, the sensitivity of the photoconductive material layer to light images to be exposed is reduced by the shielding effect (filter effect) of each toner, whereby it is difficult to obtain a constant exposure condition.

Also, since the conventional sensitizing dyes absorb the visible light, they have no sensitivity to the wave lengths of the infrared region; or in order that the photoconductive material layer has a sensitivity to the wave lengths in the infrared region, a large amount of the sensitizing dye must be used. Therefore, it is difficult to manufacture laser printers using an inexpensive and high illuminance light source such as a semiconductor laser.

SUMMARY

In a photosensitive composition for electrophotography comprising polyvinylcarbazole or a derivative thereof and a sensitizing dye, the compound of the following general formula is used as the sensitizing dye for being capable of constituting a toner-applied surface having a high sensitivity and having no background coloring;

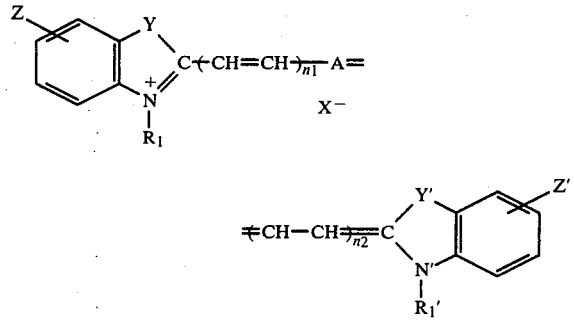

wherein Y represents S or

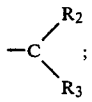

Y′ represents S or

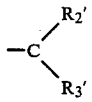

(wherein $R_2$, $R_3$, $R_2'$ and $R_3'$ each represents an alkyl group, said $R_2$ and $R_3$ together and $R_2'$ and $R_3'$ together may form a ring); Z and Z′ represents a halogen atom, a nitro group, a cyano group, or an alkylsulfonyl group; $R_1$ and $R_1'$ each represents a substituted or unsubstituted alkyl group; A represents —CH=CH—CH=,

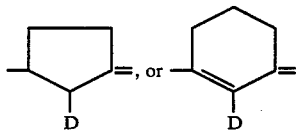

(wherein D represents a halogen atom or

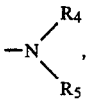

wherein $R_4$ and $R_5$ each represents a substituted or unsubstituted alkyl or phenyl group); $n_1$ and $n_2$ each represents 0 or a natural number and $n_1+n_2 \geqq 2$; and $X^-$ represents an anion.

An electrophotographic photosensitive element comprises a substrate, a conductive layer formed on one surface thereof and the photosensitive composition layer formed the conductive layer.

DISCLOSURE OF INVENTION

The invention provides a photosensitive material for electrophotography which has a sensitivity only to the wave lengths in the infrared region, whereby the light absorption of the sensitizing dye does not cause coloring and hence the background coloring does not occur, and which has no sensitivity to the visible light, whereby the reduction in sensitivity due to the filter effect of each toner for color electrophotography does not occur.

Therefore, according to this invention, there is provided a photosensitive material for electrophotography comprising polyvinylcarbazole or a derivative thereof and a sensitizing dye, wherein said sensitizing dye is represented by the following general formula (I)

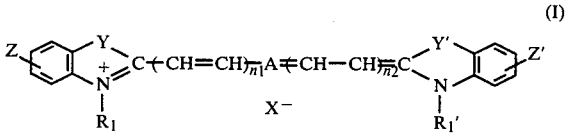

(I)

Wherein

A is selected from —CH=CH—CH=,

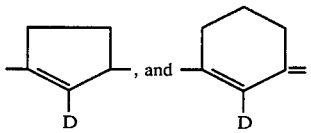

(wherein D represents a halogen atom such as Cl, Br, etc., or

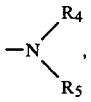

wherein $R_4$ and $R_5$ each represents a substituted or unsubstituted alkyl or phenyl group);

$n_1$ and $n_2$ each represents 0 or a natural number, and $n_1+n_2 \geqq 2$;

Y represents S or

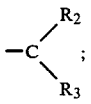

Y′ represents S or

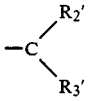

(Wherein $R_2$, $R_3$, $R_2'$ and $R_3'$, which may be the same or different, each represents an alkyl group having preferably 1 to 6 carbon atoms; said $R_2$ and $R_3$ together and said $R_2'$ and $R_3'$ together may form a ring);

Z and Z′ each represents a halogen atom, a nitro group, a cyano group or an alkylsulfonyl group having preferably 1 to 8 carbon atoms;

$R_1$ and $R_1'$ each represents an alkyl group having preferably 1 to 25 carbon atoms and may have a substituent; and $X^-$ represents an anion such as, for example, a halogen atom, an alkylsulfuric acid group, an allylsulfonyl group, a perchlorate, a tetrafluoroborate, etc.

The photosensitive materials obtained by defining, as described above, A, Y, Y′, Z and Z′ in the aforesaid general formula (I) have a practical sensitivity only to the wave lengths in the infrared region. Also, examples of PVCz and the derivatives thereof which are used for the electrophotographic photosensitive materials of this invention are illustrated below, but not limited to them.

Poly-N—vinylcarbazole

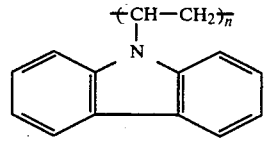

Poly-3-bromo-N—vinylcarbazole

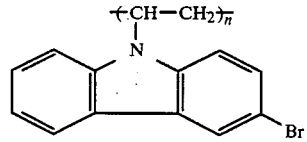

Poly-3,6-dibromo-N—vinylcarbazole

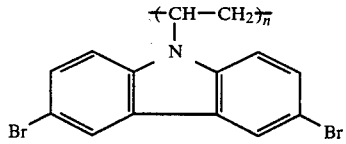

According to this invention, there is also provided an electrophotographic photosensitive element comprising a substrate, a conductive layer formed on one side of the substrate, and a photosensitive layer formed on the conductive layer, said photosensitive layer mainly comprising polyvinylcarbazole or a derivative thereof and a sensitizing dye, said sensitizing dye being a compound represented by the aforesaid general formula (I).

In the electrophotographic photosensitive material and element as described above, the sensitizing dye shown by the general formula (1) above is used in an amount of preferably 0.1 mg to 100 mg, and more preferably 0.25 mg to 5 mg per gram of PVCz or the derivative thereof. If the amount of the sensitizing dye is less than 0.1 mg, the sensitivity is insufficient, and if that amount is over 100 mg, the static electrification characteristics of the photosensitive layer is deteriorated. The compound of the aforesaid general formula (I) and PVCz or the derivative thereof are used for a photosensitive material for electrophotography in the following manner. For exmaple, PVCz or the derivative thereof is dissolved in a proper solvent such as a mixture of monochlorobenzene and methylene chloride and the compound of the general formula (I) is dissolved in, for example, chloroform or a mixture of chloroform and dimethylformamide, the resulting solutions are mixed with each other, and the mixture is formed into a film or coated on a support and dried to form a film.

As the support for the photosensitive element of this invention, there may be mentioned a transparent conductive film such as, for example, a polyethylene terephthalate film having a thin layer of a conductive metal formed by vacuum-deposition, a metal plate, such as an aluminum plate and a copper plate, and a paper.

Also, the photosensitive material for electrophotography of this invention may contain a resin such as polycarbonate as a reinforcing agent.

The photosensitive material for electrophotography of this invention has sensitivity only in the infrared region, whereby the photosensitive material can form a colorless photoconductive layer having no absorption of the visible light in a direct type electrophotography. Also, in the photoconductive layer formed using the photosensitive material of this invention, since the concentration of the sensitizing dye can be increased without causing coloring, a desired high-sensitivity can be obtained for the photoconductive layer. Furthermore, since the photoconductive layer formed using the photosensitive material of this invention has a photosensitivity in the infrared region, a semiconductor laser or a light emitting diode, which is smaller than a gas laser, can be used as a light source for exposure, which enables to produce small-sized printers.

The electrophotographic photosensitive element of this invention can be used for each of a dry development process and a liquid development process, which is a fundamental process of electrophotography, as well as for each of a direct process and a transfer process.

BRIEF DESCRIPTION OF DRAWINGS

The FIGURE is a graph showing a spectral absorption characteristics of a sensitizing dye used in an example of this invention.

BEST MODE FOR CARRYING OUT THE INVENTION

The invention will be described in more detail by referring to the following examples.

EXAMPLE 1

In a mixed solvent of 80 ml of monochlorobenzene and 20 ml of methylene chloride was dissolved 4 g of poly-N-vinylcarbazole (PVCz). To the resulting solution is added a solution of 6 mg of a dye, 1,1'-dimethyl-3,3,3',3'-tetramethyl-5,5'- dinitro-2,2'-heptamethineindocyanine perchlorate in a mixed solvent of chloroform and dimethylformamide (in mixing ratio of 4:1). The solution thus prepared was coated on a transparent conductive film at a thickness of 10 μm (after drying) and dried to provide a photosensitive element having a photoconductive layer. The conductive film used above was a 100 μm-thick polyethylene terephthalate film having a transparent, vacuum-deposited thin film (less than 1 μm) of In-Sn-oxide (ITO). A corona dischare was applied onto the photoconductive layer of the photoconductive element obtained in this example in the dark and the static electrification characteristic (a half decay period of electric potential) was measured. The result obtained indicates that the photoconductive layer had a sensitivity of 20 lux.sec. in terms of half decay exposure. Also, the absorption maximum wave length of the photosensitive element was 778 nm and the photosensitivie element, when examined with the naked eye, was colorless and transparent. The accompanying FIGURE is a graph showing the spectral absorption characteristics of the sensitizing dye used in this example.

EXAMPLE 2

In a mixed solvent of 80 ml of monochlorobenzene and 20 ml of methylene chloride were dissolved 4 g of PVCz and 1 g of polycarbonate resin. To the resulting solution is added a solution of 4 mg of a dye, 1,1'-di-n-dodecyl-3,3,3',3'-tetramethyl-5,5'-dinitro-2,2'-heptamethineindocyanine perchlorate in 4 ml of chloroform. Separately, a 5% aqueous solution of polyvinyl alcohol was coated on a transparent conductive film as in Example 1, at a thickness of 5 μm (after drying) and dried, and the solution prepared as above was then coated on the layer to a dry thickness of 10 μm and dried to provide a photosensitive element having a photoconductive layer.

The photosensitive element had a sensitivity of 20 lux.sec in terms of half decay exposure and the absorption maximum wave length of 770 nm. The photosensitive element was colorless and transparent.

EXAMPLE 3

The photoconductive layer of the photosensitive element obtained in Example 2 was negatively charged by applying a corona discharge of 6 KV using an conventional electrophotographic process. A projection exposure of a white and black original was then applied onto the charged photoconductive layer by using a photographic enlarger having a tungsten lamp as the light source, to form a latent image. After development of the latent image with a wet-type carbon black toner, an excellent black and white image having fidelity to the original and having no background coloring was obtained.

EXAMPLE 4

A color image was formed by repeating three times the same consecutive steps of charging, projection exposure and liquid development, as in Example 3, using black and white originals for blue-purple (B), green (G) and red (R) images which had been color-separated into B, G and R, for color printing in the combinations of a B original and a yellow toner; a G original and a Magenta toner; and an R original and a cyan toner. In the development, the sensitivity of the photoconductive layer was not reduced even in the portions where the toners were overlapped, and thus an excellent color image without background coloring was obtained. Also, even when the order of application of the above-mentioned toners was optionally changed, an excellent color image was obtained in each case.

EXAMPLE 5

In a mixed solvent of 80 ml of monochlorobenzene and 20 ml of methylene chloride were dissolved 4 g of PVCz and 0.8 g of a polycarbonate resin. To the resulting PVCz solution was added 6 ml of a 0.1% solution of a dye, 1,1'-dioctyl-3,3,3',3'-tetramethyl-5,5'-disulfomethyl-2,2'-heptamethineindocyanine perchlorate in chloroform to provide a coating solution for a photoconductive layer. Then, the coating solution was coated, as in Example 2, on a transparent conductive film having a polyvinyl alcohol layer at a thickness of 10 μm (after drying) and dried to provide a photosensitive element having a photoconductive layer. The photosensitive element had a sensitivity of 14 lux.sec. in terms of half decay exposure, had the absorption maximum wave length of 756 nm, and was substantially transparent without almost showing absorption in the wave length region shorter than 700 nm.

Furthermore, when an image was formed in the same manner as in Example 4 using the photosensitive element, the color image obtained was very excellent.

EXAMPLE 6

To the PVCz solution having the same composition as in Example 5 was added 6 ml of a 0.1% solution (the solvent was a mixed solvent of 1 part by volume of DMF and 4 parts by volume of chloroform) of a dye, 1,1'-dibutyl-3,3,3',3'-tetramethyl-5,5'-dinitro-2,2'-heptamethineindocyanine perchlorate to provide a coating composition for a photoconductive layer. The resulting photoconductive coating composition was coated, as in Example 2, on a transparent conductive film having a polyvinyl alcohol layer, at a thickness of 8 μm (after drying) and dried to provide a photosensitive element. The photosensitive element had the absorption maximum wave length of 772 nm and a sensitivity of 20 lux.sec. After negatively charging the photosensitive element as in Example 3, the photosensitive element was exposed to the video signals by scanning a semiconductor laser having an oscillation wave length of 780 nm as a light source, and subjected to a liquid development as in Example 4 to provide a yellow image. Thereafter, by successively effecting the steps of charging, exposure to light, development and drying, a Magenta toner and a cyan toner were applied, whereby a color image having no background coloring and a very high resolving power was obtained.

As described above, since the photoconductive material for electrophotography of this invention exhibits a photoconductivity due to the absorption only of the wave lengths in the infrared region, the photoconductive material has no background coloring, and hence it has a toner-applied surface having high whiteness; and since the photosensitive material of this invention shows no reduction in sensitivity due to the application of toners at the formation of color image, a color image having high fidelity is obtained.

What is claimed is:

1. A photosensitive material for electrophotography comprising polyvinylcarbazole or a derivative thereof and a sensitizing dye, wherein said sensitizing dye is represented by the general formula

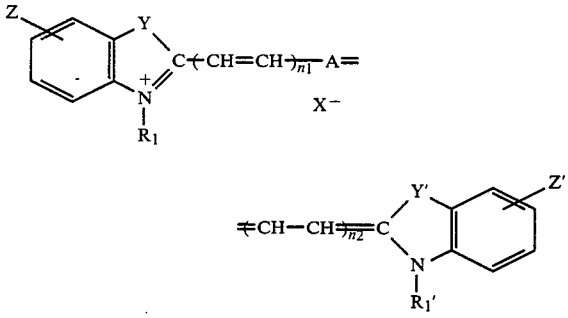

wherein Y represents S or

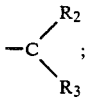

Y' represents S or

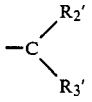

(wherein $R_2$, $R_3$, $R_2'$ and $R_3'$ each represents an alkyl group; said $R_2$ and $R_3$ together and said $R_2'$ and $R_3'$ together may form a ring); Z and Z' each represents a halogen atom, a nitro group, a cyano group, or an alkylsulfonyl group; $R_1$ and $R_1'$ each represents a substituted or unsubstituted alkyl group; A is selected from —CH=CH—CH=,

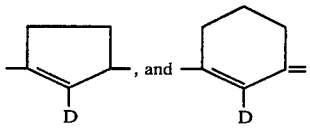

(wherein D represents a halogen atom or

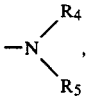

wherein $R_4$ and $R_5$ each represents a substituted or unsubstituted alkyl or phenyl group); $n_1$ and $n_2$ each represents 0 or a natural number and $n_1+n_2 \geqq 2$; and $X^-$ represents an anion.

2. The photosensitive material as claimed in claim 1, which contains the sensitizing dye in an amount of 0.1 to 100 mg per gram of polyvinylcarbazole or a derivative thereof.

3. The photosensitive material as claimed in claim 1, which contains the sensitizing dye in an amount of 0.25 to 5 mg per gram of polyvinylcarbazole or a derivative thereof.

4. The photosensitive material as claimed in claim 1, wherein $n_1$ and $n_2$ each is 1, and A is —CH=CH—CH=.

5. The photosensitive material as claimed in claim 1, wherein Y and Y' each is

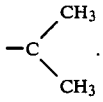

6. The photosensitive material as claimed in claim 1, wherein Z and Z' each is $-NO_2$.

7. The photosensitive material as claimed in claim 6, wherein $R_1$ is $-C_8H_{17}$.

8. The photosensitive material as claimed in claim 6; wherein $X^-$ is $ClO_4^-$.

9. An electrophotographic photosensitive element comprising a substrate, a conductive layer formed on one side of the substrate, and a photosensitive material layer formed on the conductive layer, wherein said photosensitive material layer comprises polyvinylcarbazole or a derivative thereof and a sensitizing dye, said sensitizing dye being represented by the general formula

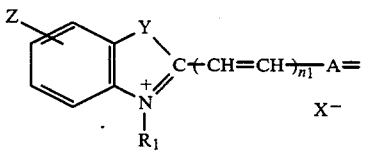

-continued

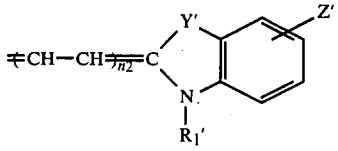

wherein Y represents S or

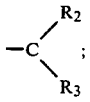

Y′ represents S or

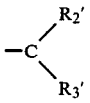

(wherein $R_2$, $R_3$, $R_2'$ and $R_3'$ each represents an alkyl group; said $R_2$ and $R_3$ together and said $R_2'$ and $R_3'$ together may form a ring); Z and Z′ each represents a halogen atom, a nitro group, a cyano group, or an alkylsulfonyl group; $R_1$ and $R_1'$ each represents a substituted or unsubstituted alkyl group; A is selected from —CH=CH—CH=,

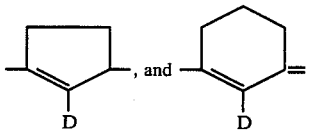

(wherein D represents a halogen atom or

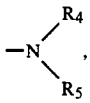

wherein $R_4$ and $R_5$ each represents a substituted or unsubstituted alkyl or phenyl group); $n_1$ and $n_2$ each represents 0 or a natural number, and $n_1+n_2 \geqq 2$; and $X^-$ represents an anion.

10. The photosensitive element as claimed in claim 9, wherein the photosensitive material layer contains the sensitizing dye in an amount of 0.1 to 100 mg per gram of polyvinylcarbazole or a derivative thereof.

11. The photosensitive element as claimed in claim 9, wherein the photosensitive material layer contains the sensitizing dye in an amount of 0.25 to 5 mg per gram of polyvinylcarbazole or a derivative thereof.

12. The photosensitive element as claimed in claim 9, wherein $n_1$ and $n_2$ each is 1, and A is —CH=CH—CH=.

13. The photosensitive element as claimed in claim 9, wherein Y and Y′ each is

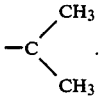

14. The photosensitive element as claimed in claim 13, wherein Z and Z′ each is $—NO_2$.

15. The photosensitive element as claimed in claim 14, wherein $R_1$ is $—C_8H_{17}$.

16. The photosensitive element as claimed in claim 14, wherein $X^-$ is $ClO_4^-$.

* * * * *